US011826815B1

(12) United States Patent
Wickham

(10) Patent No.: US 11,826,815 B1
(45) Date of Patent: Nov. 28, 2023

(54) HIGHWAY DIVIDER CABLE TENSIONING APPARATUS

(71) Applicant: Benjamin Wickham, Ponca City, OK (US)

(72) Inventor: Benjamin Wickham, Ponca City, OK (US)

( * ) Notice: Subject to any disclaimer, the term of this patent is extended or adjusted under 35 U.S.C. 154(b) by 0 days.

(21) Appl. No.: 18/200,847

(22) Filed: May 23, 2023

(51) Int. Cl.
*B21F 9/00* (2006.01)
*E01F 13/02* (2006.01)

(52) U.S. Cl.
CPC ..... *B21F 9/002* (2013.01); *E01F 13/028* (2013.01)

(58) Field of Classification Search
CPC ..... B21F 9/002; E01F 13/028
See application file for complete search history.

(56) References Cited

U.S. PATENT DOCUMENTS 3,990,182 A * 11/1976 Linder ..... E01F 13/028 49/34
4,157,171 A 6/1979 Hasselas
5,176,341 A * 1/1993 Ishikawa ..... B64F 1/14 244/116
5,507,471 A 4/1996 Mercurio

* cited by examiner

*Primary Examiner* — David M Upchurch
(74) *Attorney, Agent, or Firm* — Dale J. Ream

(57) ABSTRACT

A tensioning apparatus for pulling together respective ends of a previously severed high-tension cable and, thus, repairing and restoring tension upon a unified cable includes a base member defining a pair of guide channels spaced apart along a common longitudinal axis. The tensioning apparatus includes a pair of tensioning arms positioned in the pair of guide channels, respectively, that is slidably movable between a relaxed configuration displaced from one another and a tensioned configuration proximate one another. Each tensioning arm includes a gripper member configured to clamp onto the respective ends of the severed cable. Hydraulic or pneumatic power is operatively coupled to the pair of tensioning arms for selectively actuating movement of the pair of tensioning arms along the guide channels between the relaxed and tensioned configurations. In other words, the ends of the severed cable are pulled tightly toward one another and joined together under tension.

20 Claims, 7 Drawing Sheets

HIGHWAY DIVIDER CABLE TENSIONING APPARATUS

BACKGROUND OF THE INVENTION

This invention relates generally to tensioning devices, sometimes referred to as winches and, more particularly, which pulls respective ends of a fractured highway divider cable toward one another in a high-tension operation using hydraulic power so that the fractured cable ends may be rejoined such that the cable has a unitary configuration.

In general, median barriers are longitudinal barriers that separate opposing traffic on a divided highway and are designed to redirect vehicles striking either side of the barrier. Median barriers significantly reduce the number of cross-median crashes. Popular median barriers include high-tension cables, metal-beam guardrails mounted to steel or wooden posts, or heavy concrete blocks. Metal cable instructions are often preferred because vehicles which cross the median are redirected and impact forces are absorbed by the cables with less injury to vehicle occupants or damage to the vehicle itself. Unfortunately, however, the cables and posts to which the cables are mounted require a higher degree of maintenance and repair over the other median barrier types.

Specifically, if a high-tension cable becomes severed, i.e., it may snap and break upon impact with a vehicle and must be rejoined together in order to function properly to restrain a future vehicle impact. Restoring a broken cable to its high-tension unitary configuration, however, is a real challenge as a connection between severed ends must be reestablished in order to function effectively the next time it is impacted by an automobile.

Therefore, it would be desirable to have a tensioning apparatus specifically configured for pulling and tensioning broken cable segments toward one another such that the broken segments may be coupled together in a unitary cable configuration. Further, it would be desirable to have a tensioning apparatus that includes a pair of grippers that may be pulled toward one another using hydraulic or pneumatic power so as to stretch and tension the cable segments. In addition, it would be desirable to have a tensioning apparatus that includes mechanical fittings configured to couple the broken cable segments together when sufficiently stretched together.

SUMMARY OF THE INVENTION

Accordingly, a tensioning apparatus for pulling together respective ends of a previously severed high-tension cable and, thus, repairing and restoring tension upon a unified cable includes a base member defining a pair of guide channels spaced apart along a common longitudinal axis. The tensioning apparatus includes a pair of tensioning arms positioned in the pair of guide channels, respectively, and slidably movable between a relaxed configuration displaced from one another and a tensioned configuration proximate one another. Each tensioning arm includes a gripper member configured to clamp onto the respective ends of the severed cable. Hydraulic or pneumatic power is operatively coupled to the pair of tensioning arms for selectively actuating movement of the pair of tensioning arms along the pair of guide channels between the relaxed and tensioned configurations. In other words, the ends of the severed cable are pulled tightly toward one another and joined together under tension.

Therefore, a general object of this invention is to provide a cable tensioning apparatus for pulling respective ends of a fractured highway median cable toward one another so as to facilitate restoring the cable to a unitary and tensioned configuration.

Another object of this invention is to provide a cable tensioning apparatus, as aforesaid, having a pair of mechanical gripper arms each configured to receive an end of a fractured highway median cable and to move the gripper arms toward one another using machine-generated power, i.e., using hydraulic or pneumatic power.

Still another object of this invention is to provide a cable tensioning apparatus, as aforesaid, in which the gripper ends of the tensioning device are engaged with end fittings, respectively, and a pin fastener such that the tensioning devise is actuated to pull the end fittings toward one another.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A highway divider cable tensioning apparatus according to a preferred embodiment of the present invention will now be described with reference to the accompanying drawings.

The tensioning apparatus 10 includes a pair of tensioning arms 20, 20' and a fluid compression assembly 30 in the form of a hydraulics system or a pneumatic system configured to actuate movement of the tensioning arms 20, 20' along respective guide channels 14, 14'.

Figure 1:
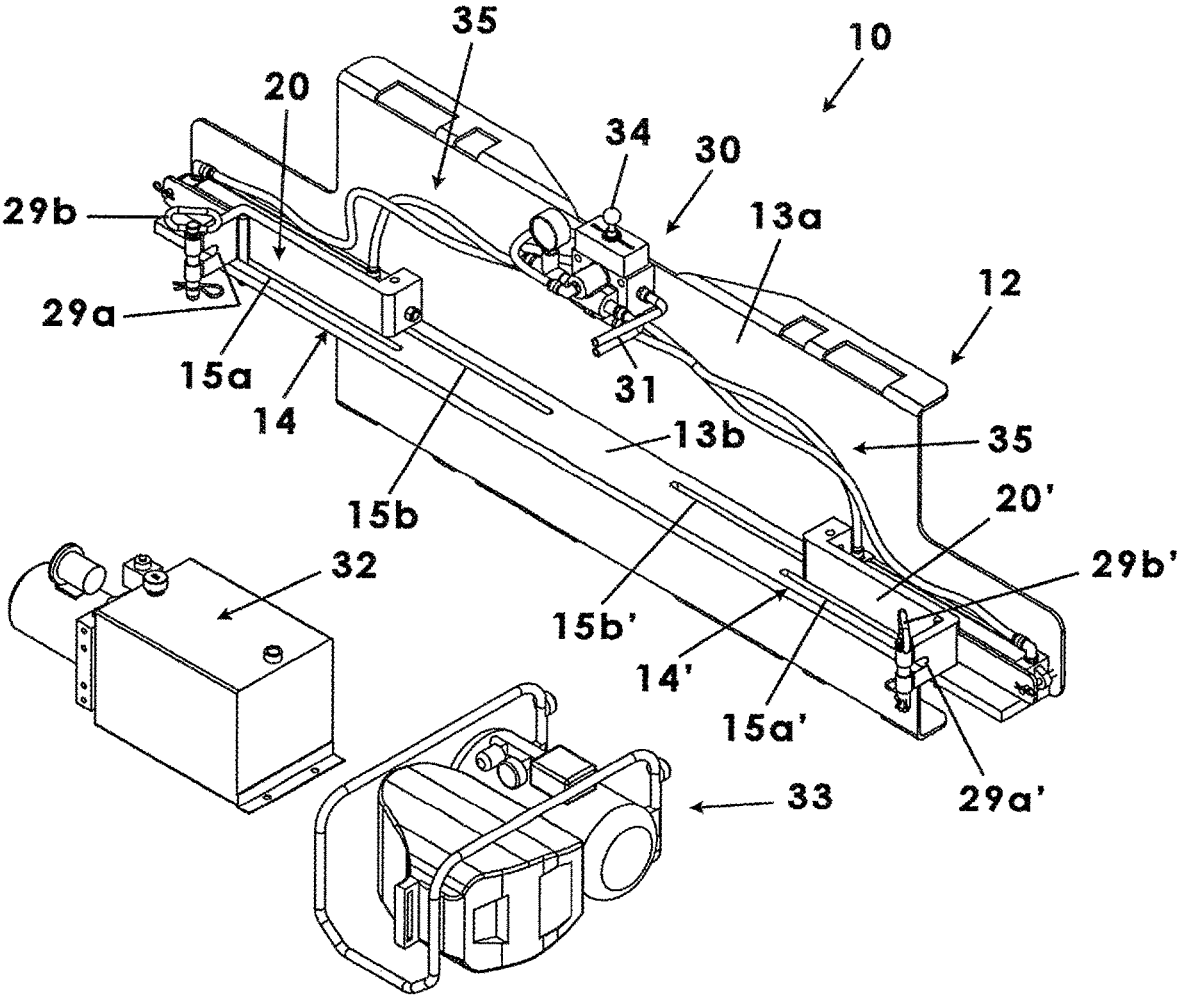
FIG. 1 is a perspective view of a highway divider cable tensioning apparatus according to a preferred embodiment of the present invention.
Figure 2A:
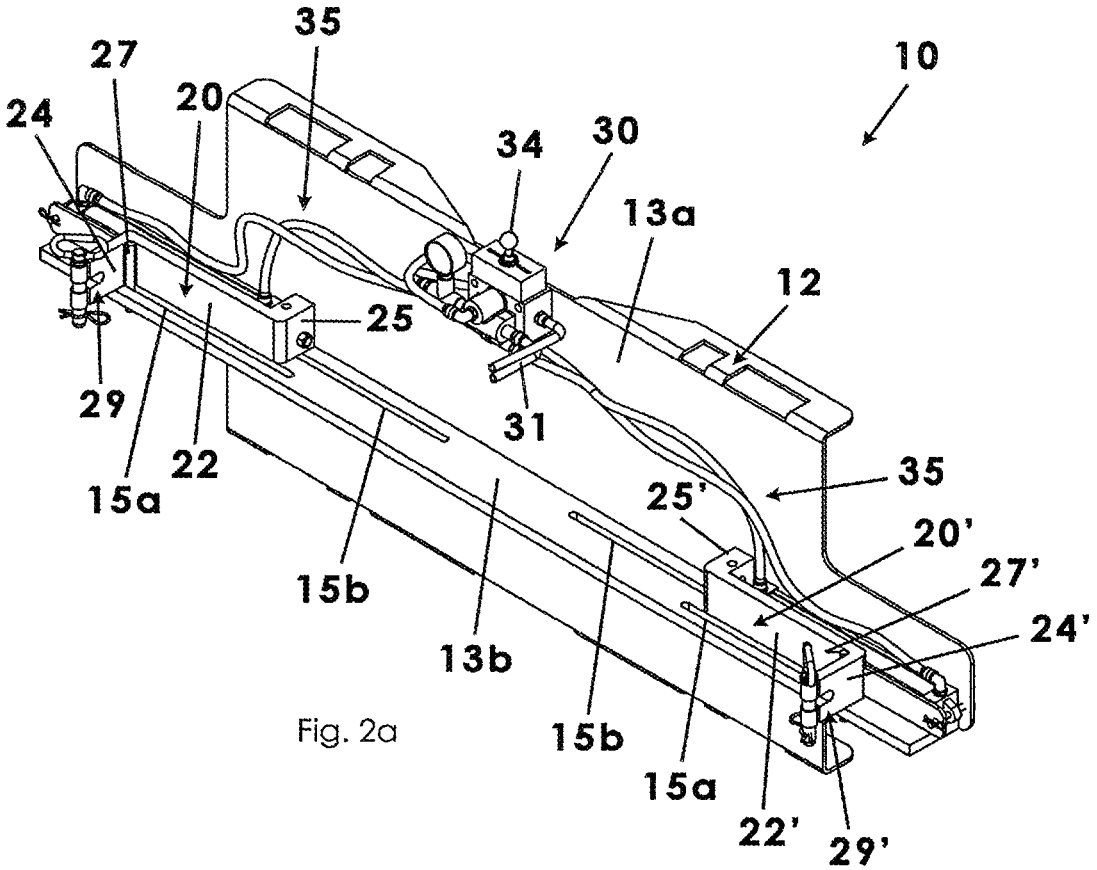
FIG. 2*a* is a perspective view of the tensioning apparatus as in FIG. 1, illustrated with the pair of tensioning arms in a maximum displaced configuration from one another.
Figure 2B:
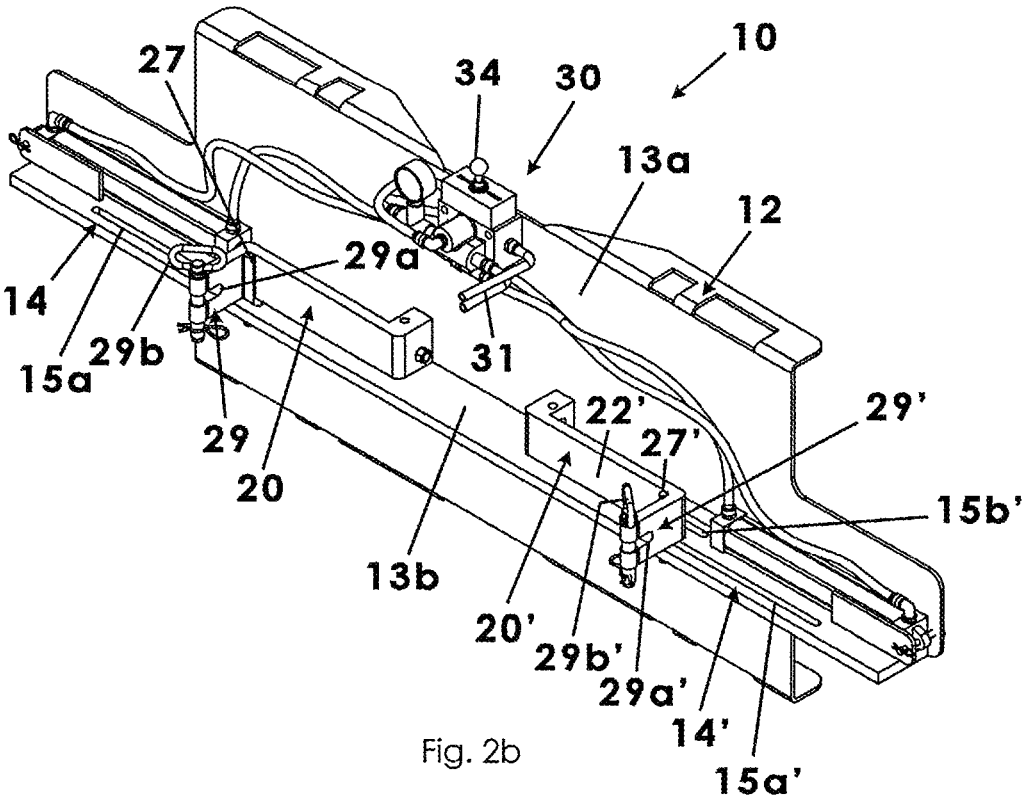
FIG. 2*b* is another perspective view of the tensioning apparatus as in FIG. 1, illustrated with the pair of tensioning arms in a maximum proximate configuration inwardly tensioned toward one another.

The tensioning apparatus 10 according to a preferred embodiment of the present invention may include a base member 12 having a configuration that provides a structure to which other components of the invention may be mounted. More particularly, the base member 12 may include a mounting plate 13*a* having a thin planer configuration to which the power assembly may be coupled and an upstanding wall (also referred to as a rail 13*b*) extending away from a longitudinal side edge of the mounting plate 13*a* (FIG. 1). In an embodiment, the mounting plate 13*a* may have a rectangular configuration. Likewise, the rail 13*b* may also have an elongate rectangular configuration that is mounted perpendicular to the plane of the mounting plate 13*a*. Together, the mounting plate 13*a* and rail 13*b* form an L-shaped configuration. Preferably, the mounting plate 13*a* serves as a shelf or platform upon which the power assembly may be mounted as will be described in more detail later.

Figure 3:
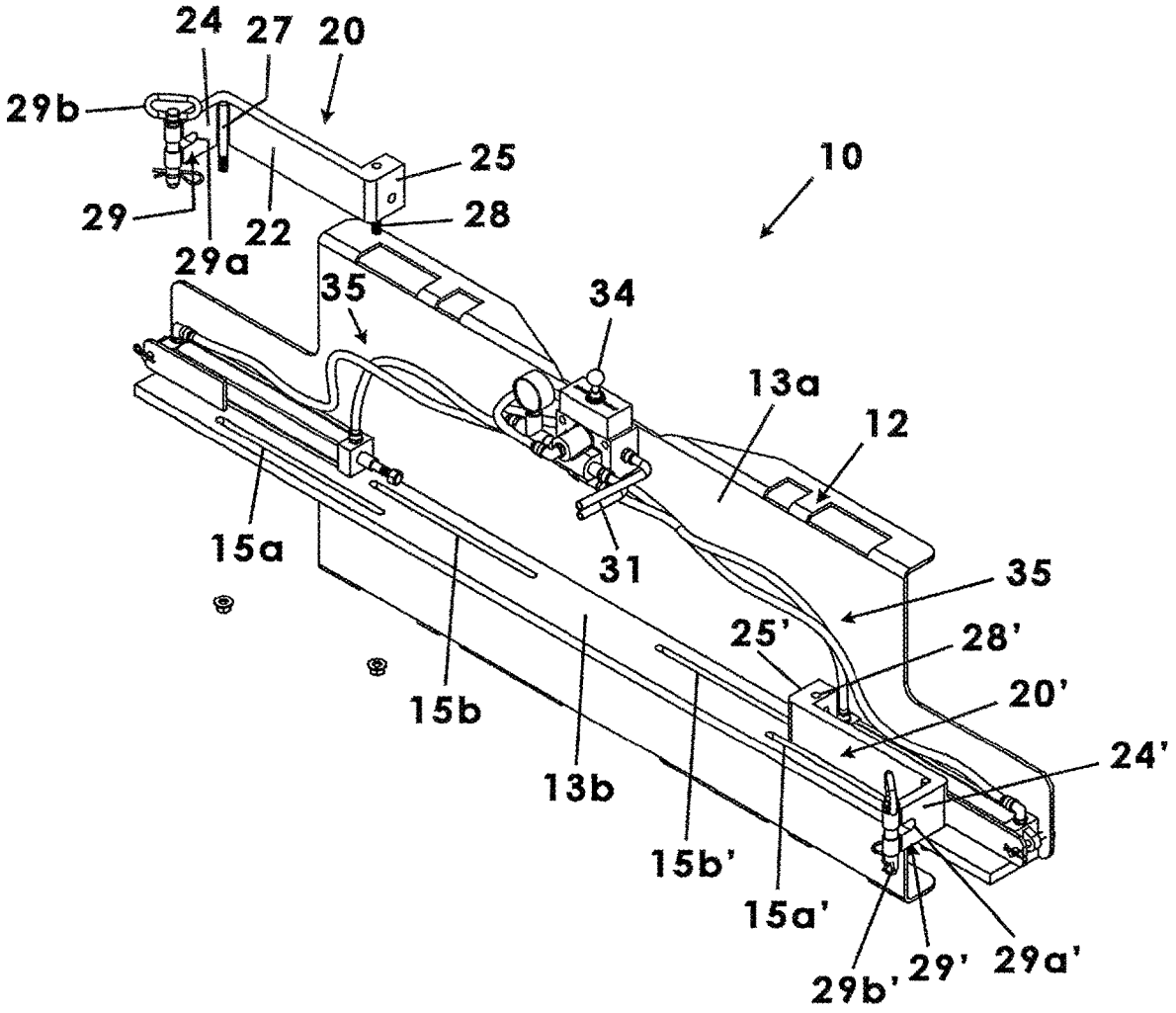
FIG. 3 is a partially exploded view of the tensioning apparatus as in FIG. 1.
Figure 4A:
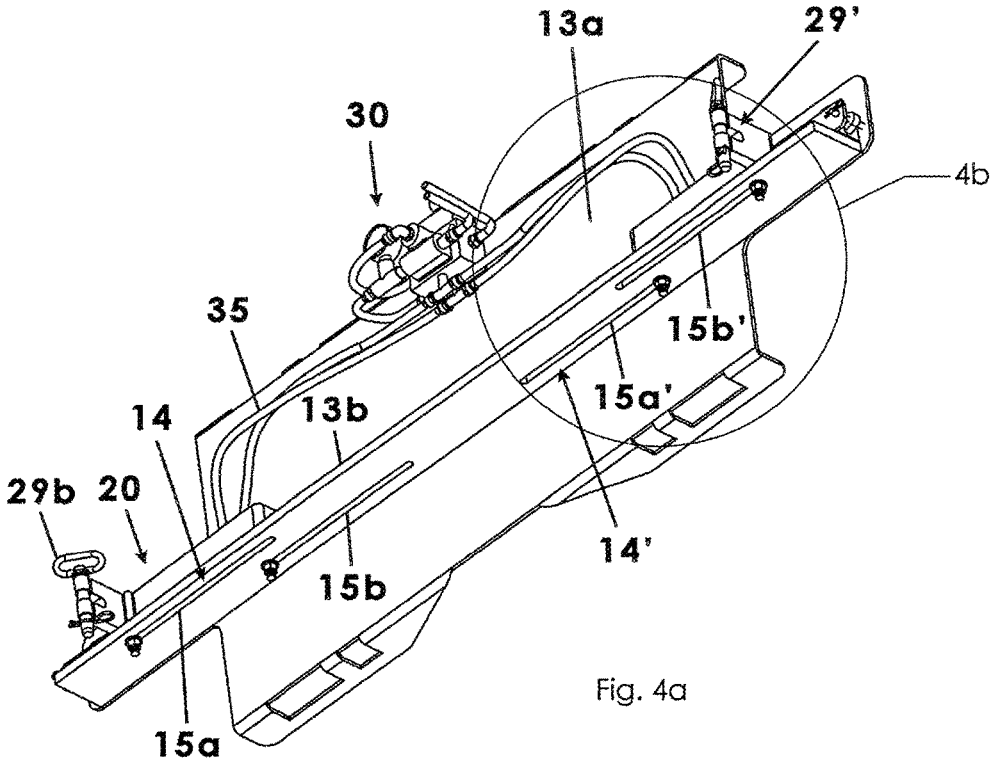
FIG. 4*a* is another perspective view of the tensioning apparatus as in FIG. 2*a* taken from a lower angle.
Figure 4B:
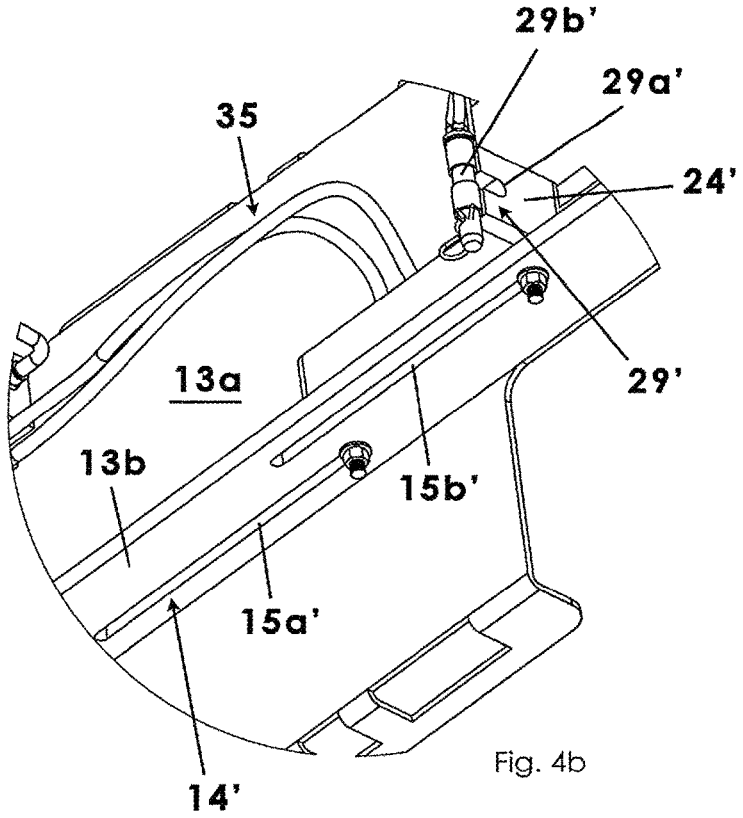
FIG. 4*b* is an isolated view on an enlarged scale taken from FIG. 4*a;*

In an embodiment, it is the rail 13*b* section of the base member 12 that defines a pair of guide channels along which the pair of tensioning arms 20 and 20' are configured to travel along, respectively. For clarity, the pair of guide channels will be referred to using reference characters 14 and 14'. As shown, the pair of guide channels 14 and 14' each include an elongate slot spaced apart from one another along a common longitudinal axis (FIG. 3). When viewed from one angle, slot 14 is seen to the left and slot 14' is seen to the right and the slots are separated by a portion of the rail 13*b*. It is along this pair of guide channels 14, 14' that the pair of tensioning arms 20, 20' are slidably movable.

The pair of guide channels 14 and 14' can each be described now in greater detail. Specifically, the guide channel 14 may include a first guide slot 15*a* having an elongate longitudinal configuration and includes a second guide slot 15*b* also having an elongate longitudinal configuration. Further, the second guide slot 15*b* is positioned downstream (i.e., inwardly), parallel, and vertically offset relative to the first guide slot 15*a*. Described another way, the second guide slot 15*b* begins where the first guide slot 15*a* ends, the second guide slot 15*b* being positioned along an auxiliary imaginary longitudinal axis that, while being parallel to an imaginary longitudinal axis defined by the first guide slot 15*a*, is slightly adjacent or offset therefrom (FIG. 3). Logically, the guide channel 14' includes substantially similar structures that are referred to as 15*a'* and 15*b'*.

As described briefly above, the pair of tensioning arms 20, 20' are slidably movable in the pair of guide channels 14, 14' and, now more particularly, it will be described how the specific structure of the tensioning arms 20, 20' provides efficiency and stability via movement in both the first guide slot 15*a* and second guide slot 15*b* (likewise in both the second guide slot 15*a'* and second guide slot 15*b'*). To be movable in both guide slots 15*a* and 15*b*, of course, the tensioning arm 20 must have a complementary configuration as will be described immediately below.

Each tensioning arm of the pair of tensioning arms 20, 20' includes a body section 22 having a generally planar configuration that is bounded by opposed proximal and distal ends 22*a* and 22*b*, respectively. The other of the pair of tensioning arms 20' will be referenced by corresponding primed reference numerals. The body section 22 has an upper surface and an opposed to lower surface. Further, the tensioning arm 20 includes a first bracket 24 extending away from the proximal end 22*a*, such as at a 900 angle. In other words, the first bracket 24 may be perpendicular to the plane defined by the body section 22. Similarly, the tensioning arm 20 may include a second bracket 25 extending away from the distal end 22*b*, such as at a 90° angle. The second guide member 24 may be perpendicular to the plane defined by the body section 22.

Still further, the pair of tensioning arms 20, 20' is operationally connected to respective slots 15*a* and 15*b* via fasteners extending from proximal and distal ends of the tensioning arm 20, respectively (likewise for tensioning arm 20' and its complementary components). The fasteners will be referred to below as first and second guide members more particularly, the tensioning arm 20 includes a first guide member 27 coupled to the upper surface of the body section 22 and which extends into engagement with the first guide slot 15*a* defined by the rail 13*b* described above and along which the tensioning arm 20 travels. Similarly, the tensioning arm 20 may include a second guide member 28 coupled to the lower surface of the body section 22 and which extends into engagement with the second guide slot 15*b* defined by the rail 13*b*. Substantially similar guide members are represented with primed reference characters associated with the other tensioning arm 20'. It is understood that the guide members described herein may be a rod, pin, linkage, or the like. Accordingly, a tensioning arm 20 may be operatively coupled to appropriate offset sections of the guide channels 14, 14'. It is understood that the vertical offset between first and second guide slots 15*a*, 15*b* is the same or complementary to the vertical offset between the guide members 27, 28, respectively, so that these components, collectively, match up appropriately to accomplish the movement of tensioning arms 20, 20' between relaxed and tensioned configurations as described above.

Figure 5A:
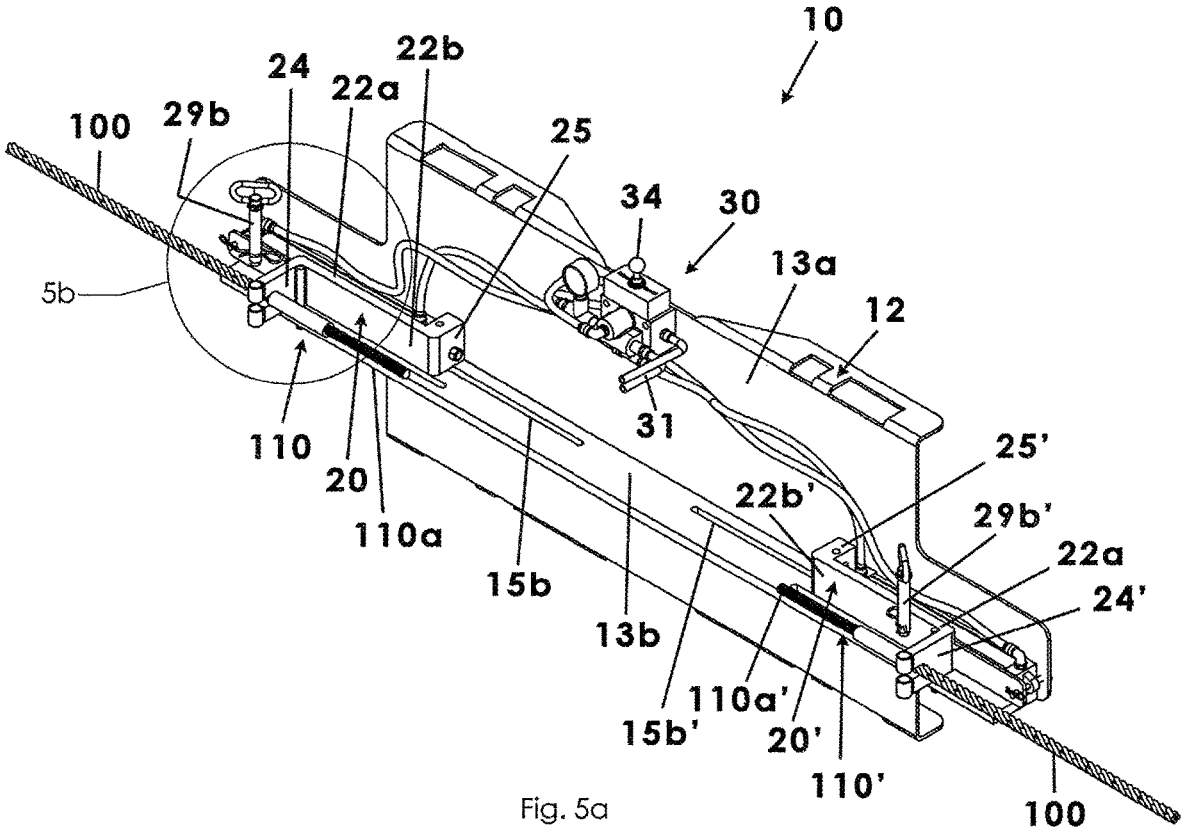
FIG. 5*a* is another perspective view of the tensioning apparatus as in FIG. 2*a*, illustrated with the retaining pan released from a respective tensioning arm.
Figure 5B:
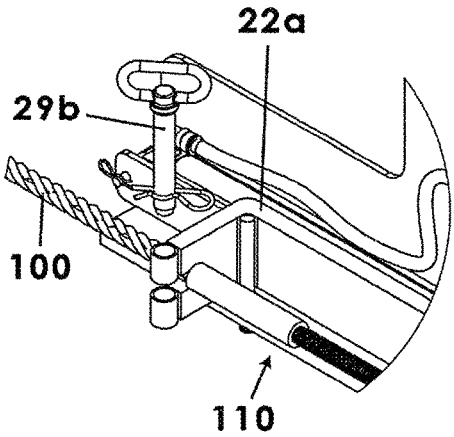
FIG. 5*b* is an isolated view on an enlarged scale taken from FIG. 5*a;*
Figure 6A:
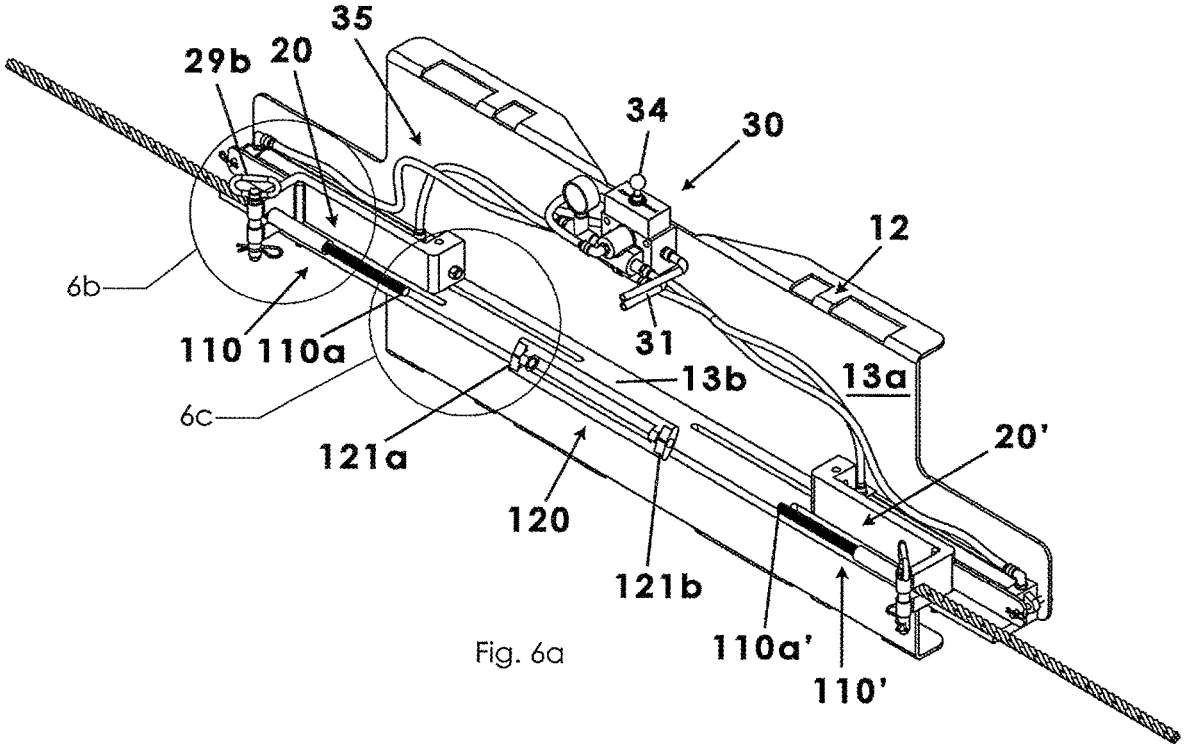
FIG. 6*a* is another perspective view of the tensioning apparatus as in FIG. 2*a*, illustrated with the retaining pan inserted into or engaged with a respective tensioning arm.
Figure 6B:
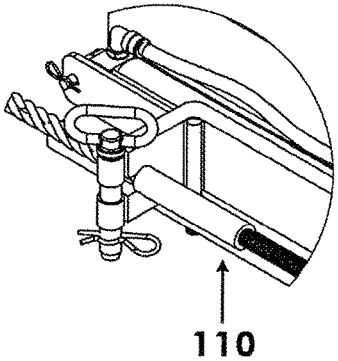
FIG. 6*b* is an isolated view on an enlarged scale taken from FIG. 6*a;*
Figure 6C:
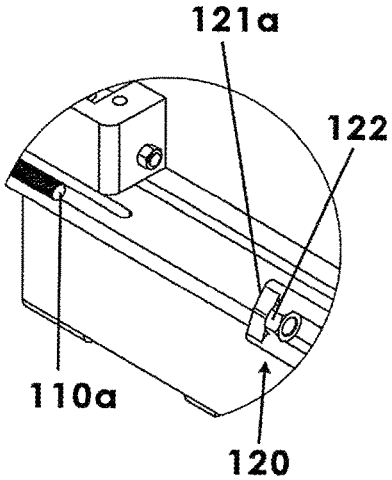
FIG. 6*c* is an isolated view on an enlarged scale taken from FIG. 6*a;*
Figure 7A:
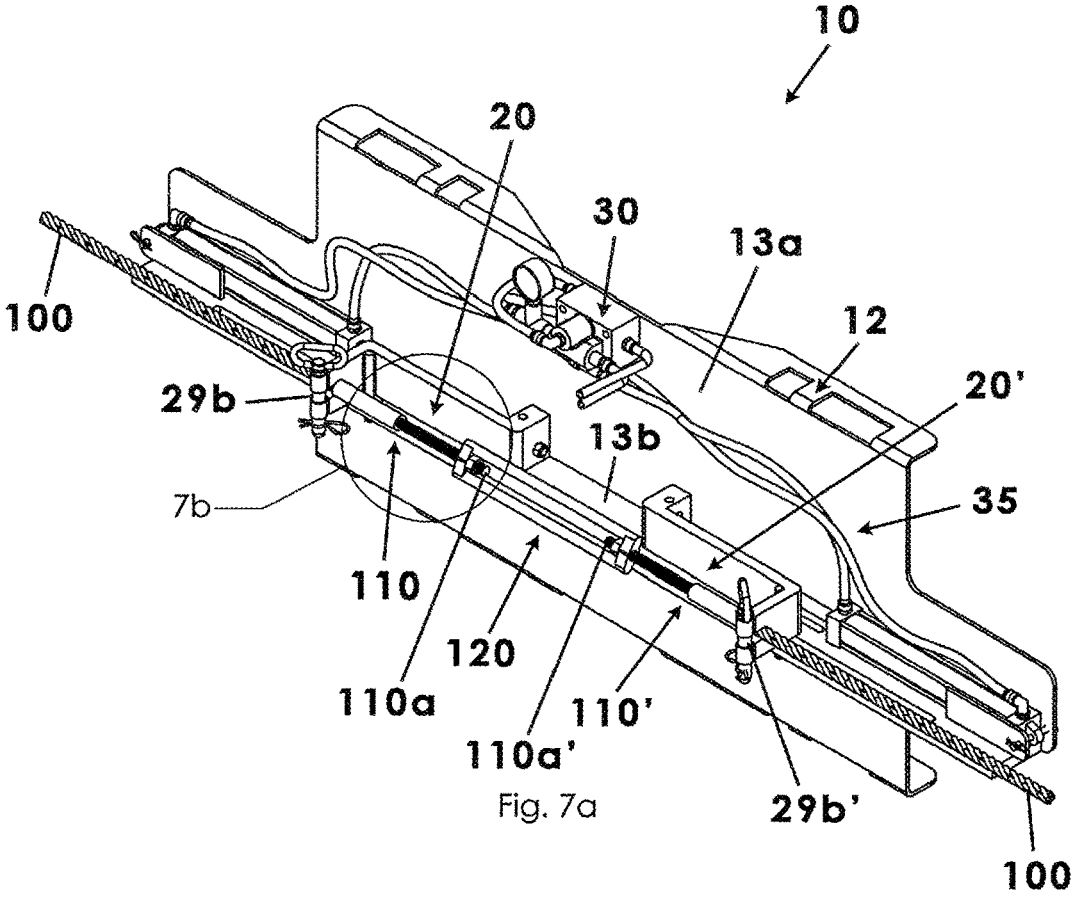
FIG. 7*a* is another perspective view of the tensioning apparatus according to a preferred embodiment of the present invention, illustrated with a pair of threaded rod fittings and a singular tensioning fitting used for rejoining previously severed ends of a severed high-tension highway divider cable.
Figure 7B:
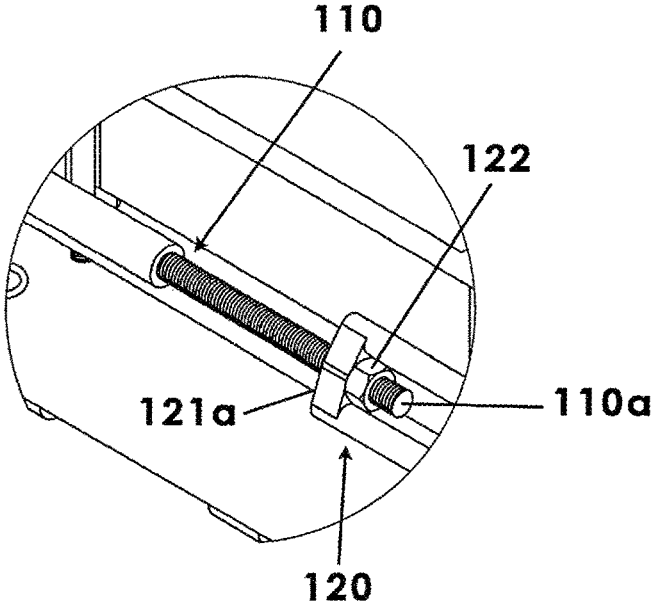
FIG. 7*b* is an isolated view on an enlarged scale taken from FIG. 7*a;*

In another critical aspect and as shown particularly in FIGS. 5*a* and 5*b*, each tensioning arm 20, 20' includes a gripper member 29, 29', such as may be coupled to a terminal edge (i.e., a free edge) of a respective first bracket 24, 24'. For the sake of clarity, the structures associated with the gripper members 29 will be further labeled and discussed although they would be manufactured in like manner relative to the gripper member 29'. The gripper member 29 may include an upstanding flange that defines a notch 29*a*, cut out, or recess that is configured to receive the severed end of the highway divider cable 100 in a friction fit nested relationship. Accordingly, respective ends of a severed divider cable 100, when duly grasped by respective gripper members 29, 29', may be pulled or tightened toward one another when respective tensioning arms 20, 20' are actuated, i.e., energized, to move toward one another by operation of the power assembly as described below. Further, each notch 29, 29' has a normally open top that may be selectively closed so as to secure the cable 100 therein (FIG. 5*a*). In other words, a terminal end of the flange that defines the notch 29*a* may be configured (shown as with loops) to receive a fastener (shown as a retaining pin 29*b*). Accordingly, the retaining pin 29*b* is movable between an inserted configuration such that the open top of the notch 29*a* is closed so as to retain the cable 100 (FIG. 6*b*) and a removed configuration such that the open top of the notch 29*a* is open such that the cable 100 may be released (FIG. 5*a*) or, as perhaps better stated, the tensioning apparatus 10 may be released from the cable 100.

The tensioning apparatus 10 includes important types of fittings for effectively pulling the severed ends of the cable 100 toward each other. In some applications, the cable 100 may be referred to as a wire rope. When the cable 100 is secured within the notch 29, 29*a*, a wire rope fitting 110, 110' is coupled to the severed end (FIG. 5*b*), such as via bonding, very high pressure, or even crimping. It is understood that the wire loop fitting 110, 110' may include a sleeve portion for connection to the cable end and a threaded rope end 110*a*, 110*a'*.

According to the process, when the threaded rope ends 110, 110*a* are sufficiently close in proximity, i.e., when the tensioning arms 20, 20' have been moved sufficiently toward one another, a single tension fitting 120 receives both threaded rope ends 110, one 110' into its interior area where they are permanently attached, such as with bolts 122, 122'. More particularly, the tension fitting 120 may include a longitudinally extending framework that defines openings at opposed ends 121*a*, 121*b* sufficient in diameter to allow the threaded rope ends 110, 110*a* to be received into its open interior area. In an embodiment, the bolts 122 may be pre-positioned immediately inwardly adjacent the opposed ends 121*a*, 121*b* of the tensioning fitting 120 and fixedly attached to respective end walls, said bolts being inwardly threaded so as to spin and tighten automatically as respective threaded rope ends 110, 110' are pulled into the interior area of the tension fitting 120 by the tensioning power of the fluid compression assembly 130 described below.

The tensioning apparatus 10 includes a power assembly (also referred to as a fluid compression assembly) that is capable of causing movement of the pair of tensioning arms 20, 20' and disconnected portions of the divider cable 100 toward one another under a significant load until the ends thereof can be fastened together such as with mechanical fittings as will be described later. Preferably, the power assembly used according to the present invention may be a hydraulics system 30 or a pneumatic system 40—each being capable of converting a fluid (such as hydraulic oil or air) into a controllable quantity of mechanical energy capable of moving the tensioning arms 20, 20' toward one another and, thus, overcoming the load that will naturally resist the load of restoring the severed highway divider cable to a tensioned configuration.

More particularly, a hydraulic system is configured to convert the fluid energy of hydraulic oil to mechanical energy, i.e., mechanical power. Similarly, a pneumatic system turns the fluid energy of air into mechanical energy. Hydraulic systems are used in a myriad of applications, including in airplanes, construction equipment, farm machinery, elevators, and the like because of their ease of use and ability to accomplish significant work by lifting heavy loads, turning a shaft, drilling precision holes, and the like with a minimum of structure or investment in a mechanical linkage. During a lift operation, a pump pushes an incompressible oil from the oil reservoir to the cylinder. This pushes the piston upward (in the present case moving the tensioning arms toward one another), providing the force necessary to raise the lift. Once the desired height is reached, the pump is switched off and the lift is held securely in position by the oil trapped within the cylinder. To return the lift to its original position, a valve is opened to release oil back into the reservoir, and the piston is lowered by gravitational force. In the case of a pneumatic system, the pump may be an air compressor.

In the present invention, the fluid compression assembly 30 (i.e., hydraulics or pneumatics) may be mounted atop the mounting plate 13*a* of the base member 12. As is known in the art, the fluid compression assembly 30 may include a distribution block, pressure gauge, and an operator lever 34 which in the present invention will be referred to as an "input" as it is the means by which a user may select a forward or rearward direction of movement to be imparted to the tensioning arms 20, 20'. Further, the fluid compression assembly 30 may include appropriate connection lines 31 leading to and from either a hydraulic pump 32 or an air compressor 33, respectively. Finally, the fluid compression assembly 30 may include operational hoses 35 to make functional connection with opposite ends of each tensioning arm 20, 20', respectively. In short, a selected degree of pressure may be selected via manipulation of the input 34 for application to the proximal 22*a*, 22*a'* and distal 22*b*, 22*b'* ends of tensioning arms 20, 20' to actuate the sliding movement along the first slots 14*a*, 14*a'* and second slots 15*a*, 15*a'*. Again, the exact configuration of a fluid compression assembly 30 may vary in configuration depending on the application.

In use, the ends of a severed cable (sometimes referred to as a threaded rope) may be trimmed to remove any rough or frayed edges such that the severed ends may be coupled to a sleeve portion of a wire rope fitting 110, 110', respectively, as described above. Thereafter, the fluid compression system 30 is operated, such as by manipulating the input 34, so as to slidably move the tensioning arms 20, 20' inwardly toward one another which, correspondingly, moves the threaded rope ends 110, 110' toward one another and, eventually, into the interior area defined by the tension fitting 120. As described above, a fastener such as a bolt is automatically tightened as the threads from the threaded rope ends 110, 110' pass through the bolt, thus securing the severed ends inside the tension fitting 120. Accordingly, the previously severed cable 100 is unified, tensioned, and ready again for service protecting drivers in opposing directions from crossover crashes.

It is understood that while certain forms of this invention have been illustrated and described, it is not limited thereto except insofar as such limitations are included in the following claims and allowable functional equivalents thereof.

The invention claimed is:

1. A tensioning apparatus for pulling respective ends of a severed high-tension highway divider cable toward one another, comprising:

a base member defining a pair of guide channels;

a pair of tensioning arms positioned in said pair of guide channels, respectively, and slidably movable between a relaxed configuration displaced from one another and a tensioned configuration proximate one another, each tensioning arm having a gripper member configured to clamp onto the respective ends of the severed high-tension highway divider cable; and a fluid compression assembly operatively coupled to said pair of tensioning arms and that is configured to selectively actuate movement of said pair of tensioning arms along said pair of guide channels between said relaxed and tensioned configurations.

2. The tensioning apparatus as in claim 1, wherein said fluid compression assembly is a hydraulic system that is configured to convert fluid energy into mechanical energy.

3. The tensioning apparatus as in claim 2, wherein said hydraulic system includes an input device in operative communication with said pair of tensioning arms and configured such that a user operation of said input device causes movement of said pair of tensioning arms along said pair of guide channels.

4. The tensioning apparatus as in claim 1, wherein said fluid compression assembly is a pneumatic system.

5. The tensioning apparatus as in claim 4, wherein said pneumatic system is configured to convert compressed air into mechanical energy so as to move said pair of tensioning arms inwardly toward one another along said pair of guide channels.

6. The tensioning apparatus as in claim 1, wherein:

each guide channel of said pair of guide channels includes a first guide slot having a longitudinal configuration and a second guide slot having a longitudinal configuration, said second guide slot being downstream, parallel, and vertically offset relative to said first guide slot;

each tensioning arm of said pair of tensioning arms includes a body section having a planar configuration and a proximal end and a distal end opposite said proximal end;

a first guide member coupled to said proximal end of said body section and positioned in said first guide slot and configured for selective slidable movement therein; and a second guide member coupled to said distal end of said body section and positioned in said second guide slot and configured for selective slidable movement therein.

7. The tensioning apparatus as in claim 6, wherein said first guide member is coupled to an upper surface of said body section and said second guide member is coupled to a lower surface of said body section such that said first guide member is vertically offset relative to said second guide member by a distance that is complementary to the vertical offset between said first guide slot and said second guide slot.

8. The tensioning apparatus as in claim 7, wherein said each tensioning arm includes a first bracket extending upwardly away from said proximal end of said body section and a second bracket extending downwardly away from said distal end of said body section, said first and second brackets each being perpendicular to upper and lower surfaces of said body section, respectively.

9. The tensioning apparatus as in claim 8, wherein each said gripper member is positioned along a terminal edge of each first bracket of each tensioning arm, respectively, wherein said each gripper member defines a notch configured for receiving a respective end of the severed high-tension highway divider cable in a nested engagement.

10. The tensioning apparatus as in claim 1, further comprising:

a pair of wire rope fittings each having a sleeve coupled to a respective severed end of the severed divider cable and a threaded rod end inwardly opposite said sleeve;

a tension fitting having an elongate linear framework bounded by opposed end walls each defining an opening in communication with an interior area, said opposed end walls each being configured to receive said the threaded rod ends of said pair of wire rope fittings, respectively, said tension fitting including a threaded fastener positioned inwardly adjacent said opposed end walls, respectively, and that is configured to tighten automatically when receiving a threaded rod end of a wire rope fitting, respectively.

11. A tensioning apparatus for imparting tension upon a previously severed high-tension highway divider cable, comprising:

a rail having a first end and a second end opposite said first end, said rail defining a first guide channel proximate said first end and a second guide channel proximate said second end, said first and second guide channels being displaced from one another along a common longitudinal axis;

a pair of tensioning arms in communication with said first and second guide channels, respectively, and slidably movable between a relaxed configuration a maximum distance from one another and a tensioned configuration a minimum distance from one another, each tensioning arm having a gripper member configured to receive severed ends of the severed high-tension highway divider cable, respectively; and a fluid compression assembly operatively coupled to said pair of tensioning arms and that is configured to selectively actuate movement of said pair of tensioning arms along said first and second guide channels, respectively, between said relaxed and tensioned configurations.

12. The tensioning apparatus as in claim 11, wherein said fluid compression assembly is one of a hydraulic system or a pneumatic system.

13. The tensioning apparatus as in claim 11, wherein said fluid compression assembly is a hydraulic system that is configured to convert fluid energy into mechanical energy, said hydraulic system having an input device in operative communication with said pair of tensioning arms and configured such that a user operation of said input device actuates a corresponding movement of said pair of tensioning arms toward one another along said first and second guide channels, respectively.

14. The tensioning apparatus as in claim 11, wherein said fluid compression assembly is a pneumatic system that is configured to convert compressed air into mechanical energy so as to move said pair of tensioning arms along said first and second guide channels, respectively, when actuated.

15. The tensioning apparatus as in claim 11, wherein:

said first and second guide channels each includes a first guide slot having a longitudinal configuration and a second guide slot having a longitudinal configuration, said second guide slot being downstream, parallel, and vertically offset relative to said first guide slot;

each tensioning arm of said pair of tensioning arms includes a body section having a planar configuration and a proximal end and a distal end opposite said proximal end;

a first guide member coupled to said proximal end of said body section and positioned in said first guide slot and configured for selective slidable movement therein; and a second guide member coupled to said distal end of said body section and positioned in said second guide slot and configured for selective slidable movement therein.

16. The tensioning apparatus as in claim 15, wherein said first guide member is a pin coupled to an upper surface of said body section and said second guide member is a pin coupled to a lower surface of said body section such that said first guide member is vertically offset relative to said second guide member by an amount that is complementary to the vertical offset between said first guide slot and said second guide slot.

17. The tensioning apparatus as in claim 15, wherein said each tensioning arm includes a first bracket extending upwardly away from said proximal end of said body section and a second bracket extending downwardly away from said distal end of said body section, said first and second brackets each being perpendicular to upper and lower surfaces of said body section, respectively.

18. The tensioning apparatus as in claim 17, wherein each said gripper member is positioned along a terminal edge of each first bracket of each tensioning arm, respectively, wherein said each gripper member defines a notch configured for receiving a respective end of the severed high-tension highway divider cable in a nested friction fit engagement.

19. The tensioning apparatus as in claim 18, further comprising a retaining pin selectively coupled to each said gripper member and that is movable between an inserted configuration blocking release of the severed end of the severed cable nested in said notch and a removed configuration release of the severed end of the severed cable nested in said notch.

20. The tensioning apparatus as in claim 11, further comprising:

a pair of wire rope fittings each having a sleeve coupled to a respective severed end of the severed divider cable and a threaded rod end inwardly opposite said sleeve;

a tension fitting having an elongate linear framework bounded by opposed end walls each defining an opening in communication with an interior area, said opposed end walls each being configured to receive the threaded rod ends of said pair of wire rope fittings, respectively, said tension fitting including a threaded fastener positioned inwardly adjacent said opposed end walls, respectively, and configured to tighten automatically when receiving a threaded rod end of a wire rope fitting, respectively.

* * * * *